US010859335B2

(12) United States Patent
Maga

(10) Patent No.: US 10,859,335 B2
(45) Date of Patent: Dec. 8, 2020

(54) LOADABLE FIXED MAGAZINE FOR SPORTING RIFLE

(71) Applicant: David Maga, Castaic, CA (US)

(72) Inventor: David Maga, Castaic, CA (US)

( * ) Notice: Subject to any disclaimer, the term of this patent is extended or adjusted under 35 U.S.C. 154(b) by 10 days.

(21) Appl. No.: 16/362,019

(22) Filed: Mar. 22, 2019

(65) Prior Publication Data

US 2019/0219352 A1 Jul. 18, 2019

Related U.S. Application Data

(63) Continuation-in-part of application No. 15/784,078, filed on Oct. 13, 2017, now Pat. No. 10,598,457.

(60) Provisional application No. 62/483,814, filed on Apr. 10, 2017, provisional application No. 62/483,822, filed on Apr. 10, 2017, provisional application No. 62/483,827, filed on Apr. 10, 2017, provisional application No. 62/794,455, filed on Jan. 18, 2019.

(51) Int. Cl.

| | |
|---|---|
| ***F41A 9/00*** | (2006.01) |
| ***F41A 17/38*** | (2006.01) |
| ***F41A 9/67*** | (2006.01) |
| *F41A 9/82* | (2006.01) |

(52) U.S. Cl.

CPC ..... *F41A 17/38* (2013.01); *F41A 9/67* (2013.01); *F41A 9/82* (2013.01)

(58) Field of Classification Search

CPC ..... F41A 9/65; F41A 9/67; F41A 9/83; F41A 9/71; F41A 17/38

USPC ..... 42/50, 49.01, 18, 87

See application file for complete search history.

(56) References Cited

U.S. PATENT DOCUMENTS

| | | | | | |
|---|---|---|---|---|---|
| 1,797,951 | A * | 3/1931 | Gaidos | F41A 9/67 | 42/50 |
| 2,477,936 | A * | 8/1949 | Molins | F41A 9/76 | 89/33.17 |
| 2,585,738 | A * | 2/1952 | Chapin | F41A 9/55 | 42/18 |
| 2,908,987 | A * | 10/1959 | Allyn | F41A 9/65 | 42/18 |
| 3,005,279 | A * | 10/1961 | Brewer | F41A 13/00 | 42/18 |
| 4,430,821 | A * | 2/1984 | Vincent | F41A 9/67 | 42/50 |
| 4,502,237 | A * | 3/1985 | Krogh | F41A 9/70 | 42/50 |
| 4,588,240 | A * | 5/1986 | Ruehl | H01R 31/08 | 439/513 |

(Continued)

*Primary Examiner* — Michael D David

(74) *Attorney, Agent, or Firm* — Manning & Kass, Ellrod, Ramirez, Trester LLP; Ronald J. Tong

(57) ABSTRACT

A loadable ammunition magazine for use with a sporting firearm includes a housing defining a cartridge-loading compartment and a follower compartment, a cover that alternately covers and reveals the cartridge-loading compartment, and a follower that urges cartridges in the cartridge-loading compartment towards a mouth of the magazine. A locking assembly prevents the magazine from being detached from the lower receiver of the firearm without disassembly of the firearm action. In one embodiment, the locking assembly includes an expandable insert, and an actuator configured to expand from a first state wherein the outer surface of the insert is spaced from the well wall to a second state wherein the outer surface of the insert tightly engages the well wall.

13 Claims, 8 Drawing Sheets

(56) References Cited

U.S. PATENT DOCUMENTS 4,614,052 A * 9/1986 Brown ..... F41A 9/83 42/50
4,688,344 A * 8/1987 Kim ..... F41A 9/83 42/50
4,707,941 A * 11/1987 Eastman ..... F41A 9/68 42/49.02
5,278,690 A * 1/1994 Vella-Coleiro ..... H04B 7/2675 379/379
5,461,811 A * 10/1995 Ciener ..... F41A 9/65 42/49.02
5,697,179 A * 12/1997 Vanmoor ..... F41A 9/65 42/50
5,732,498 A * 3/1998 Arreguin ..... F41A 17/44 42/70.02
5,806,224 A * 9/1998 Hager ..... F41A 17/38 42/18
6,212,815 B1 * 4/2001 Fitzpatrick ..... F41A 9/65 224/196
6,311,603 B1 * 11/2001 Dunlap ..... F41A 3/72 42/2
6,481,136 B1 * 11/2002 Fitzpartick ..... F41A 9/65 42/18
6,739,082 B2 * 5/2004 Christensen ..... F41A 9/61 42/49.02
6,807,764 B1 * 10/2004 Phillips ..... F41A 9/83 42/87
7,162,824 B1 * 1/2007 McCormick ..... F41A 19/10 42/75.03
7,200,964 B2 * 4/2007 Gates ..... F41A 9/67 42/49.01
7,444,775 B1 * 11/2008 Schuetz ..... F41A 9/71 42/49.02
7,497,044 B2 * 3/2009 Cammenga ..... F41A 9/67 42/49.01
7,941,955 B2 * 5/2011 Stone ..... F41A 9/25 42/50
8,316,567 B2 * 11/2012 Douglas ..... F41A 9/67 42/50
8,418,390 B1 * 4/2013 Wright ..... F41A 9/61 42/49.01
8,720,095 B2 * 5/2014 Wright ..... F41A 9/65 42/50
8,756,845 B2 * 6/2014 Harris ..... F41A 17/38 42/49.01
9,103,614 B2 * 8/2015 Froehle ..... F41A 9/67
9,121,652 B1 * 9/2015 Mangiameli ..... F41A 9/67
9,303,934 B1 * 4/2016 Kazsuk ..... F41A 9/83
9,341,421 B2 * 5/2016 Findlay ..... F41A 9/65
9,395,130 B2 * 7/2016 Jacobson ..... F41A 9/65
9,482,478 B2 * 11/2016 Newman ..... F41A 21/02
9,683,797 B2 * 6/2017 Boyarkin ..... F41A 9/66
2011/0173858 A1 * 7/2011 Troy ..... F41A 9/65 42/50
2012/0102803 A1 * 5/2012 Troy ..... F41C 23/16 42/71.01
2014/0223790 A1 * 8/2014 Wilson ..... F41A 9/65 42/49.01
2015/0096214 A1 * 4/2015 Jones, III ..... F41A 9/71 42/49.01
2015/0276339 A1 * 10/2015 Shreve ..... F41A 9/71 42/50
2018/0292153 A1 * 10/2018 Maga ..... F41A 9/67
2018/0292154 A1 * 10/2018 Maga ..... F41A 9/67
2018/0292155 A1 * 10/2018 Maga ..... F41A 9/67
2018/0292156 A1 * 10/2018 Maga ..... F41A 3/66
2019/0219348 A1 * 7/2019 Maga ..... F41A 9/67

* cited by examiner

LOADABLE FIXED MAGAZINE FOR SPORTING RIFLE

CROSS-REFERENCE TO RELATED APPLICATIONS

This application claims priority from U.S. provisional patent application No. 62/794,455, filed Jan. 18, 2019.

In addition, this application is a continuation-in-part of U.S. patent application Ser. No. 15/784,078, filed Oct. 13, 2017, now US publication no. US2018/0292153 A1. U.S. patent application Ser. No. 15/784,078 claims priority from the following three U.S. provisional patent applications: Ser. No. 62/483,814, filed Apr. 10, 2017; Ser. No. 62/483,822, filed Apr. 10, 2017; and Ser. No. 62/483,827, filed Apr. 10, 2017. The entire contents of each of the above provisional applications are incorporated herein by reference.

TECHNICAL FIELD

The present disclosure relates in general to magazines for sporting rifles and, more particularly, to a loadable fixed magazine for an AR-15-style rifle.

BACKGROUND

Concern over mass shootings in America has led some U.S. states such as California and New York to ban the use of "assault-style" weapons. The definition of "assault style" weapons varies from state-to-state, but in California AR-15-type sporting rifles with detachable magazines fall under this umbrella. Specifically, current California law requires that all semi-automatic rifles using centerfire ammunition must be at least 30" in length and must have fixed magazines that hold no more than 10 rounds, where a "fixed magazine" is defined as a magazine that cannot be removed without disassembly of the firearm action.

In response to this legislation, firearms manufacturers have begun manufacturing and selling semiautomatic firearms with fixed magazines. Examples of such firearms are disclosed in U.S. Pat. No. 5,806,224 to Hager, and U.S. Pat. No. 7,941,955 B2. For gun owners who wish to avoid the expense of buying new guns, kits for converting firearms with detachable magazines to firearms with fixed magazines are also available. One such kit is disclosed in U.S. Pat. No. 8,756,845 B2. However, a need exists for other ways of bringing non-compliant sporting rifles into compliance with the laws of California and other states.

SUMMARY

The present disclosure relates to an ammunition magazine for use with a firearm having an upper receiver and a lower receiver, where the lower receiver includes a magazine well for receiving the ammunition magazine. The ammunition magazine is fixed to the lower receiver by a locking assembly.

In a general aspect of the disclosure, the ammunition magazine includes a housing having an upper portion configured to be contained within the magazine well, and a lower portion configured to extend downwardly below the lower receiver. The lower portion of the housing defines a cartridge-loading compartment configured to receive and contain a stack of ammunition cartridges, and a follower compartment having a finger pull slot with a bottom hook. The upper end of the cartridge-loading compartment terminates in a mouth that communicates with the interior of the magazine well, and the lower end of the cartridge-loading compartment is accessible through an opening in the lower portion of the housing. A movable cover or door alternately covers or reveals the opening. A follower assembly within the follower compartment urges ammunition cartridges in the cartridge-loading compartment upwardly towards the mouth of the ammunition magazine.

In one aspect of the disclosure, the follower assembly comprises a follower, a finger-pull attached to the follower, and a spring. The finger-pull extends through the finger-pull slot and is movable when released from the bottom hook. The spring is configured to be compressed by the follower when the finger-pull is compressed by the follower when the finger-pull is engaged with the bottom hook, and to expand when the finger-pull is disengaged from the bottom hook, thereby allowing the follower to urge the stack of cartridges towards the mouth of the ammunition magazine.

In some embodiments, the extension portion is configured to limit capacity of the ammunition magazine to no more than ten cartridges.

In some embodiments, the follower assembly includes: a spring guide, configured to provide support and stability for the spring and to provide alignment for the spring when in an extended position and when in a compressed position, the spring guide having a shape that fits inside the follower when the spring is in the compressed position; and a follower arm, fixedly attached to the finger-pull, with the follower arm also configured to flexibly attach to the follower, so as to allow movement of the finger-pull into the bottom hook.

In some embodiments, the cover has a pair of cover grooves, the pair of cover grooves being configured to be slidably supported by a pair of slide rails on the follower compartment.

In some embodiments, the cover has a raised cover stop ridge that cooperates with a cover stop groove in the follower compartment to prevent the cover from moving beyond the cartridge-loading portion opening.

In some embodiments, the follower compartment has a magazine bottom cap which supports and protects the follower assembly.

In some embodiments, the extension portion, the cartridge-loading portion, the follower compartment, and the follower assembly are each made from at least one of: metal or plastic.

In some embodiments, the locking assembly includes an attachable locking tab at the mouth of the upper portion of the ammunition magazine housing.

In other embodiments, the locking assembly includes a horizontally expandable insert held within a depression or cavity in the upper portion of the magazine housing, and an actuator configured to expand the insert from a first state wherein the outer surface of the insert is spaced from the well wall to a second state wherein the outer surface of the insert tightly engages the well wall.

In one aspect, the expandable insert is formed of a resilient material capable of expanding horizontally when acted upon by a vertical compressive force, and the actuator is a screw configured to exert the vertical compressive force on the insert.

In a preferred embodiment, the insert defines a bore having an internally threaded lower portion. The bore in the insert is aligned with an elongated bore that opens through the top wall of the magazine housing. When an externally threaded screw is inserted through the aligned bores in the magazine housing and the insert and rotated, it exerts a vertical force on the insert, causing the insert to compress in the vertical direction and to expand in the horizontal direction. The horizontal expansion of the insert causes it to tightly engage the inner wall of the lower receiver, locking the magazine in place. Once the upper receiver is assembled on the lower receiver, the screw is not accessible and thus cannot be loosened. As a result, the ammunition magazine cannot be detached without separating the upper and lower receivers.

BRIEF DESCRIPTION OF THE DRAWINGS

The invention will be more fully understood from the following detailed description, in conjunction with the following figures, wherein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
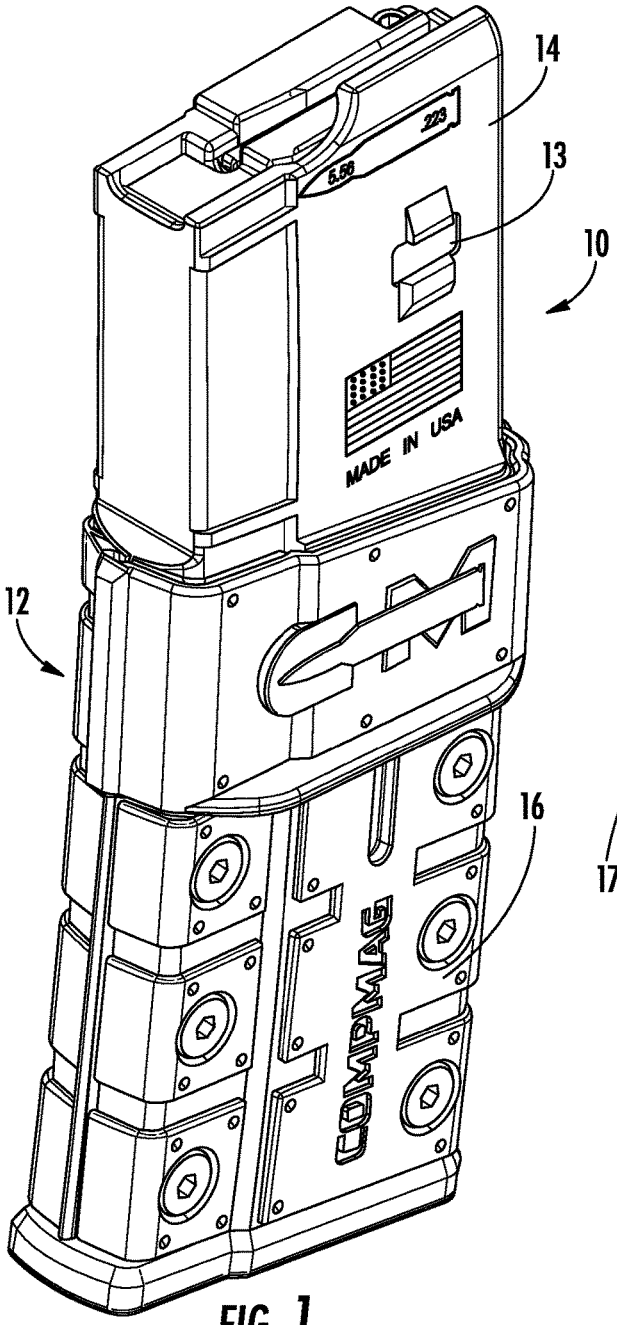
FIG. 1 is an obverse perspective view of the ammunition magazine with the cover in the closed position and the finger-pull in the up position.
Figure 2:
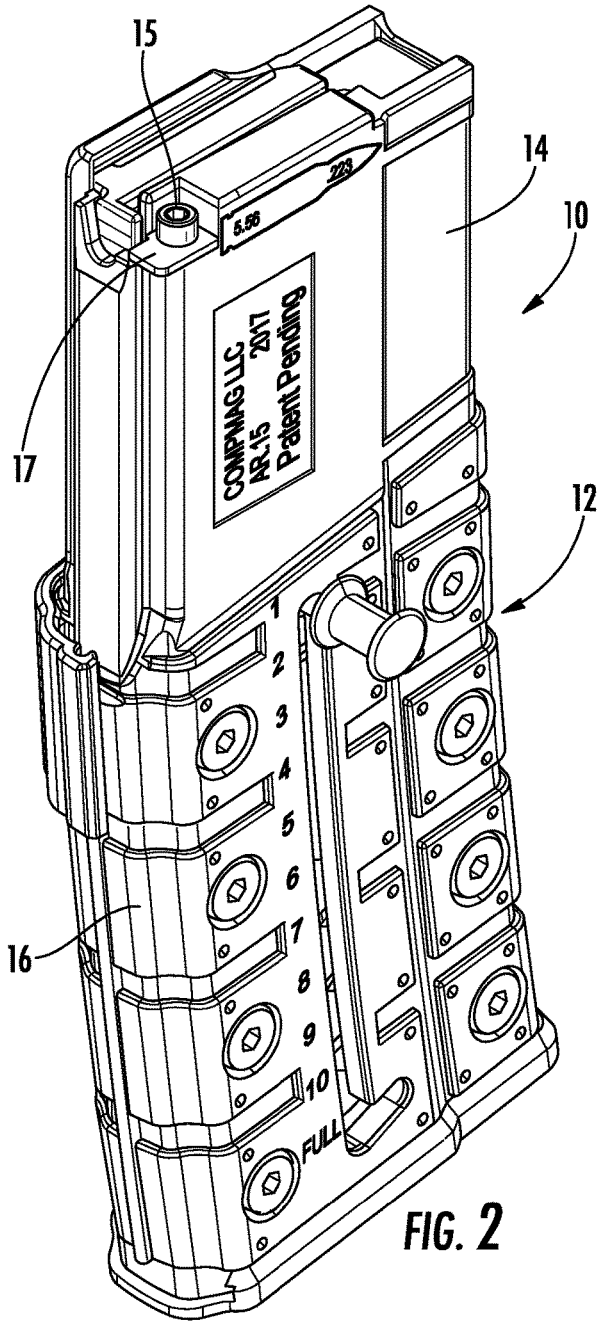
FIG. 2 shows the reverse side of FIG. 1.

With reference to FIGS. 1 and 2, an ammunition magazine of the present disclosure, indicated in its entirety by the numeral 10, includes a housing 12 having an upper portion 14 (also called an extension portion) configured to be contained within the magazine well in the lower receiver of firearm, and a lower portion 16 configured to extend downwardly below the lower receiver of the firearm. A magazine insertion grip 13 formed on the upper portion 14 of the housing 12 is configured to be snapped into a mating recess or hole in the lower receiver when the ammunition magazine 10 is inserted into the lower receiver. In addition, a locking assembly, consisting of a locking screw 15 and an attachable blocking tab 17, is provided for securing the ammunition magazine 10 to the lower receiver, preventing the ammunition magazine 10 from being removed from the firearm without separating the upper receiver from the lower receiver. The attachable blocking tab 17 is attached after insertion of the ammunition magazine 10 into the magazine well, and before re-engaging the upper receiver with the lower receiver.

Figure 3:
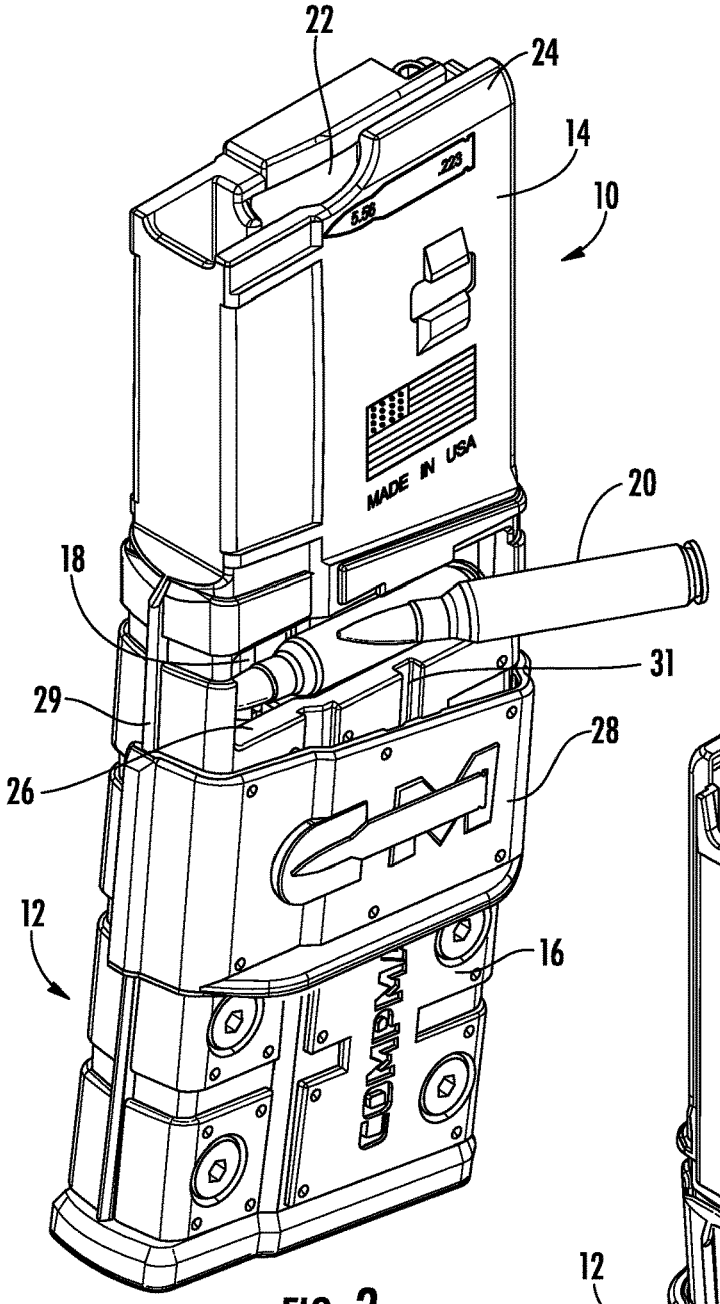
FIG. 3 is an obverse perspective view of the ammunition magazine with the cover in the open position, showing cartridges being added to the stack of cartridges.

As best seen in FIG. 3, the housing 12 defines a cartridge-loading compartment 18 configured to receive and contain a stack of ammunition cartridges 20. The upper end of the cartridge-loading compartment 18 terminates in a mouth 22 that communicates with the magazine well and is partially covered by a feed lip 24. The lower end of the cartridge-loading compartment 18 is accessible through a side opening 26 in the lower portion 16 of the housing 12. A cover or door 28 is slidable along at least one side rail 29 to alternately cover or reveal the opening 26. The extent to which the cover 28 can be moved downward is limited by a cover stop groove 31.

Figure 4:
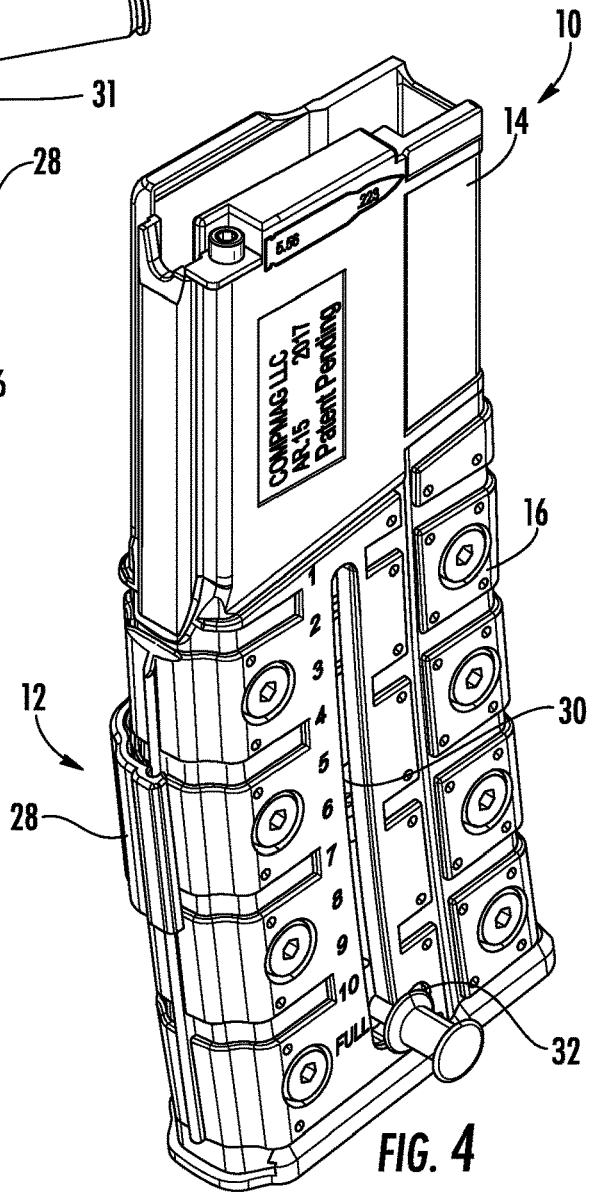
FIG. 4 is a reverse perspective view of the ammunition magazine with the finger-pull in the down position.

As best seen in FIG. 4, the side of the housing 12 opposite the slidable cover 28 includes a finger-pull slot 30 that opens into a follower compartment containing a follower assembly for actuating the slidable cover 28. The finger-pull slot 30 has a hook-shaped lower end 32.

Figure 5:
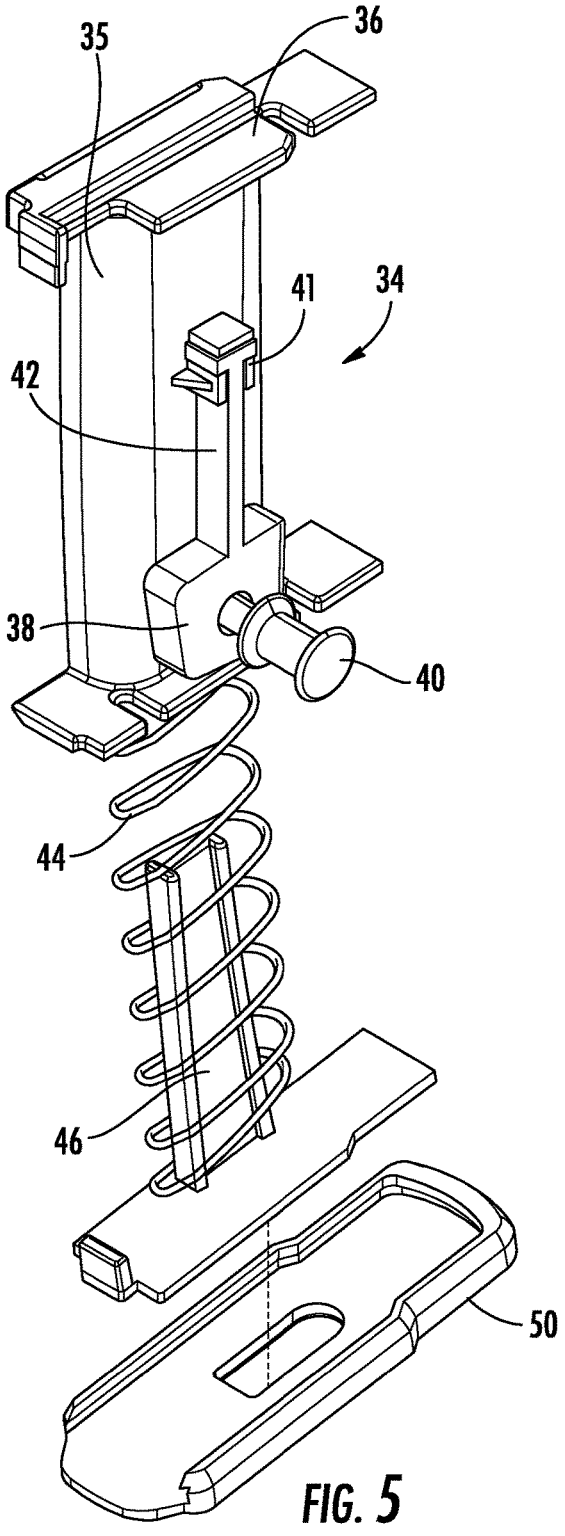
FIG. 5 is an exploded obverse view of the follower assembly and the magazine bottom cap.
Figure 6:
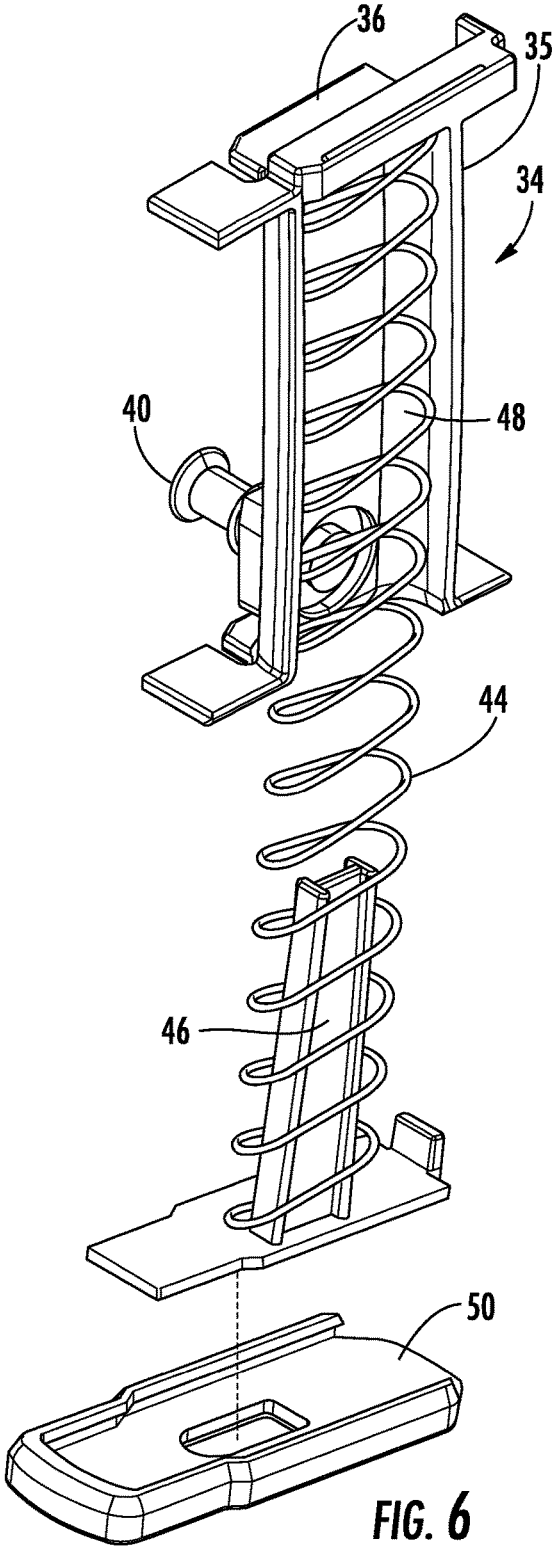
FIG. 6 shows the reverse side of FIG. 5.

The follower assembly 34, shown in FIGS. 5 and 6, includes a follower 35 having a follower top plate 36 that supports the stack of ammunition cartridges. A follower arm 38 provides a fixed attachment point for a finger-pull 40 that slides vertically along the upper portion of the finger-pull slot in the magazine housing and horizontally along the hooked-shaped lower end of the finger-pull slot. A follower arm T-mount 41 provides flexible attachment points for the top of the follower arm 38, allowing the finger-pull 40 to change position when it reaches the hook-shaped lower end of the finger-pull slot. In addition, the stem 42 of the follower arm 38 is thin and flexible, allowing flexible movement of the finger-pull 40 within the hook-shaped lower end of the finger-pull slot.

Movement of the follower top plate 36 is controlled by a spring 44 that is supported and held in alignment by a spring guide 46. The spring guide 46 is contained within the hollow interior 48 of the follower 35 when the spring 44 is compressed. A magazine bottom cap 50 supports the spring guide 46 and also serves as the structural bottom of the follower assembly 34.

Figure 7:
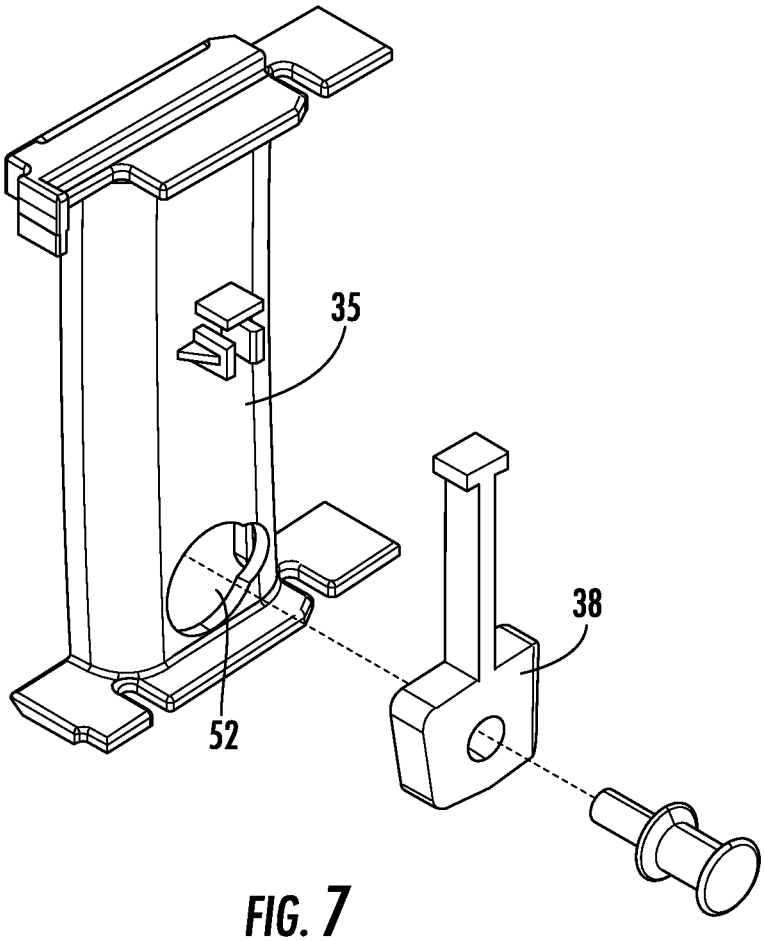
FIG. 7 is an exploded view of the follower, the follower arm, and the movable finger-pull.

As best seen in FIG. 7, the lower end of the follower end 35 defines an open cutout 52 that allows horizontal movement of the follower arm 38, which in turn allows the finger-pull 40 to move flexibly within the hook-shaped bottom end of the finger-pull slot.

Figure 8:
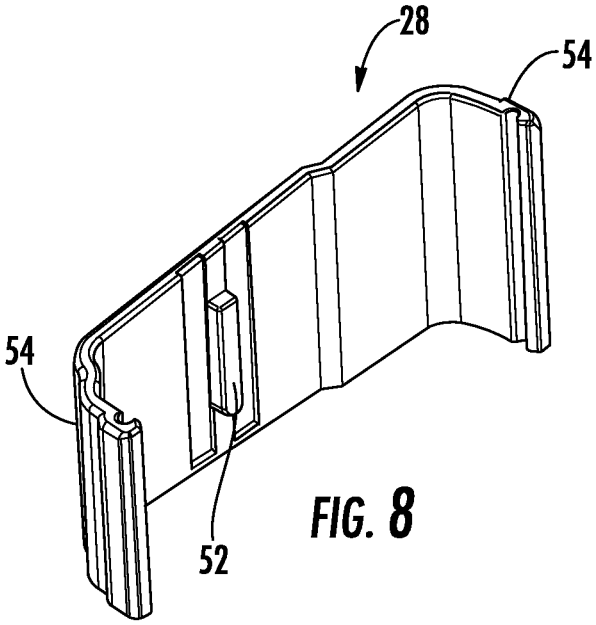
FIG. 8 is an inside perspective view of the cover.

The cover 28 of the magazine housing, shown in FIG. 8, includes a raised cover stop ridge 52 that cooperates with the cover stop groove in one of the side walls of the magazine to prevent the top edge of the cover 28 from traveling below the side opening of the cartridge-loading compartment. The cover 28 also includes a pair of cover grooves 54 that cooperate with the side rails on the magazine housing to slidably support the cover 28.

Figure 9:
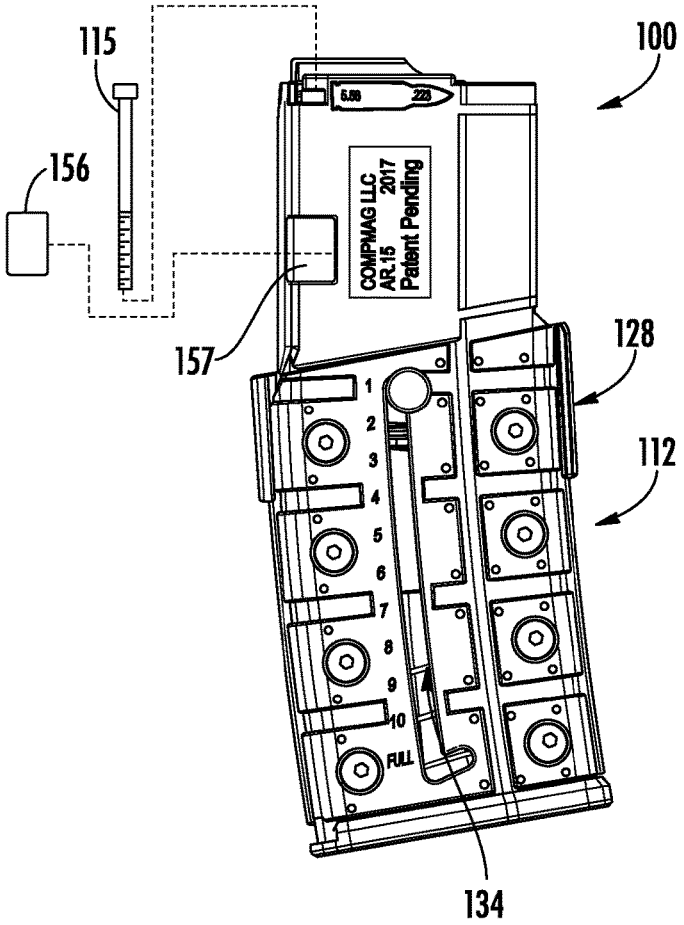
FIG. 9 is a reverse view of an ammunition magazine according to an alternate embodiment of the invention, showing the locking assembly in exploded relationship to the magazine housing.
Figure 10:
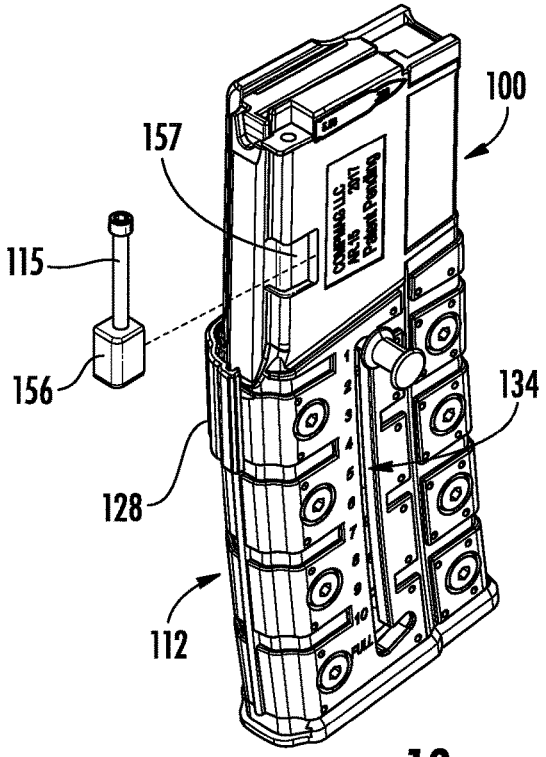
FIG. 10 is a reverse perspective view of the ammunition magazine of FIG. 9, showing the locking assembly assembled within the housing.

FIGS. 9 and 10 show an alternate embodiment of the invention, indicated in its entirety by the numeral 100, wherein the structure of the housing 112, cover 128, and follower assembly 134 are the same as in the embodiments of FIGS. 1-8, but the locking assembly includes a horizontally expandable insert 156 that is held within a depression or cavity 157 in a rear corner of the upper portion 114 of the ammunition magazine housing 112. The horizontally expandable insert 156, which is made of a strong resilient material that compresses in a vertical direction and expands in a horizontal direction in response to downward movement of a locking screw 115 within an elongated bore in the housing 112.

Figure 11A:
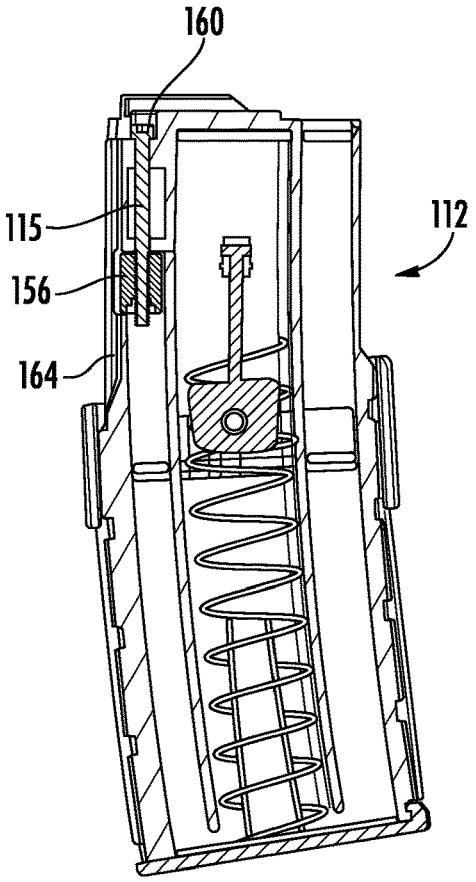
FIG. 11A is a sectional view showing the interior of the ammunition magazine with the locking assembly in a pre-expanded state.
Figure 11B:
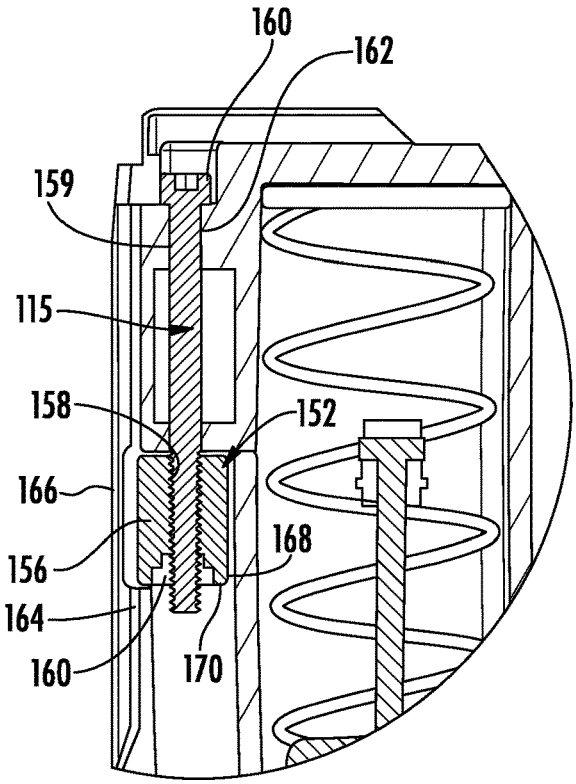
FIG. 11B is an enlarged sectional view of the upper rear corner of the ammunition magazine, with the locking assembly in a pre-expanded state.

As seen in FIGS. 11A and 11B, the horizontally expandable insert 156 defines a bore 158 having a molded, internally threaded plug 160 inserted in its bottom end. The screw 115 includes an enlarged head 160 that extends radially beyond the perimeter of the elongated bore 159 in the housing, and is supported by the upper wall 162 of the housing 112. The dimensions of the horizontally expandable insert 156 in its pre-expanded state are approximately the same as the dimensions of the insert cavity 157. In other words, the length or height of the insert 156 is approximately the same as the length or height of the cavity 157, and the width or depth of the insert 156 is approximately the same as the width or depth of the cavity 157. Thus, the outer surface of the insert 156 is substantially flush with the outer wall 164 of the magazine housing 112, and is spaced from the inner surface of the rear wall 166 of the magazine well when inserted into the magazine well. At the same time, the bottom end 168 of the insert 156 is substantially flush with the bottom wall 170 of the cavity 157.

Figure 12A:
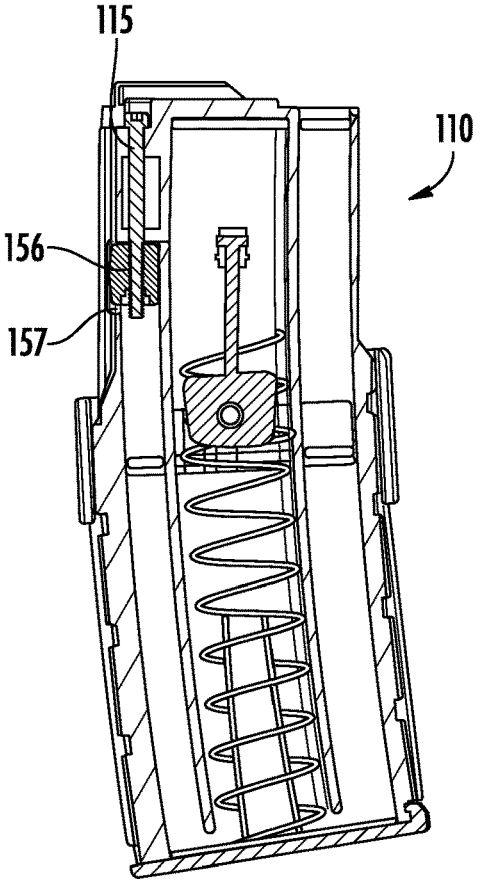
FIG. 12A is a sectional view showing the interior of the ammunition magazine with the locking assembly in an expanded state.
Figure 12B:
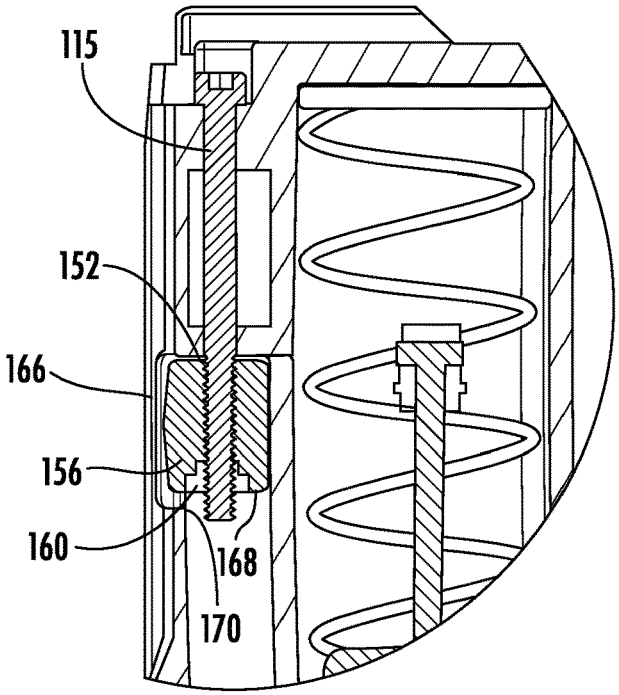
FIG. 12B is an enlarged sectional view of the upper rear corner of the ammunition magazine, with the locking assembly in an expanded state.

To secure the magazine 110 to the lower receiver of a firearm, a user simply tightens the screw 115, compressing the horizontally expandable insert 156 vertically so that its bottom end 168 rides up along the threaded lower end of the screw 115, away from the bottom wall 170 Of the cavity 157, as shown in FIGS. 12A and 12B. As the insert 156 is compressed vertically, it expands or bulges horizontally, until its outer surface tightly engages the inner surface of the rear wall 166 of the magazine well, locking the magazine 110 in place. Once the upper receiver is assembled on the lower receiver, the screw 40 is not accessible and thus cannot be loosened without separating the upper and lower receivers.

Figure 13:
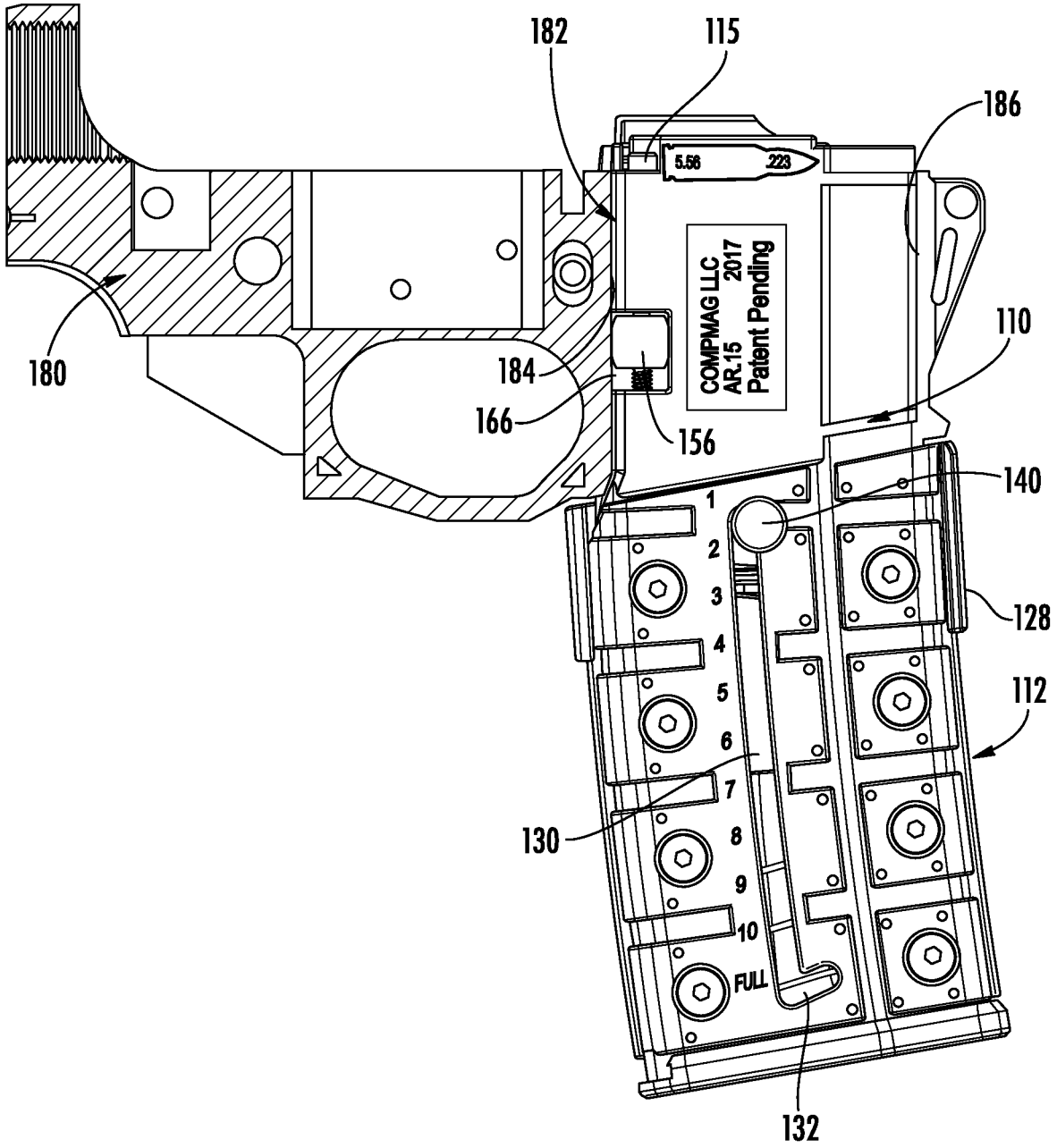
FIG. 13 is a reverse side view showing the ammunition magazine of FIGS. 9-12B, fixed to the lower receiver of an AR-15-type sports rifle.

FIG. 13 shows the ammunition magazine 110 of FIGS. 9-12B, fixed to the lower receiver 180 of an AR-15-type sports rifle. The receiver 180 includes a magazine well 182 including the rear well wall 166 and a front well wall 186. The screw 115 has been tightened, causing the walls of the horizontally expandable insert 156 to bulge outwardly and contact the inner surface of the rear wall 166 of the magazine well 182, locking the magazine 110 in place.

Because the magazine is fixed, it cannot be loaded from the top. To load it, a user pulls downwardly on the finger-pull 140 to retract the spring-loaded cartridge follower. The user then locks follower in its lowermost position by moving it horizontally into the hooked shape lower end 132 of the finger-pull slot 130.

The cover 128 on the opposite wall of the magazine housing 112 is then lowered, revealing the cartridge opening and providing access to the cartridge-loading compartment. Once this access is provided, the user can easily load ammunition cartridges into the cartridge-loading compartment.

Once the stack of cartridges is loaded, the cover 128 is closed by sliding it upwards, and the finger-pull 140 is unhooked from hooked shape lower end 132 of the finger-pull slot 130. Once the finger-pull 140 is released from the hooked shape lower end 132, the cartridge follower pushes up against the stack of cartridges 20, allowing the magazine 110 and the firearm to work normally.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An ammunition magazine for use with a firearm having a receiver defining a magazine well including a well wall, the ammunition magazine including;

a housing having an upper portion configured to be contained within the magazine well, the upper portion including a top surface, an outer surface, a cavity opening outwardly toward the well wall, and a bore extending vertically downwardly through the top surface of the upper portion and intersecting with the cavity, and a lower portion configured to extend downwardly below the receiver; and a locking assembly configured to secure the housing to the receiver, the locking assembly including an expandable insert contained within the cavity in the upper portion of the housing, and an actuator extending downwardly through the bore in the upper portion of the housing and configured to exert a compressive force on the expandable insert.

2. An ammunition magazine for use with a firearm having an upper receiver and a lower receiver, the lower receiver defining a magazine well including a well wall, the ammunition magazine including;

a housing having an upper portion configured to be contained within the magazine well, a lower portion configured to extend downwardly below the lower receiver, a cartridge-loading compartment including an upper end extending through the upper portion of the housing and defining a mouth communicating with the magazine well, and a lower end extending into the lower portion of the housing and accessible through a side opening in the housing;

a cover coupled to the housing and mounted for movement from a closed position covering the side opening to an open position revealing the side opening;

a follower assembly mounted within a follower compartment and configured to urge ammunition cartridges in the cartridge-loading compartment toward the mouth of the cartridge-loading compartment; and a repeatedly reusable locking assembly mounted in the upper portion of the housing and configured to prevent the magazine from being removed from the firearm while the upper receiver is assembled over the lower receiver.

3. The ammunition magazine according to claim 1, wherein:

the cavity has a fixed length and width; and the insert is formed of resilient material and is expandable under compression from a first state having a length and width approximately equal to the length and width of the cavity to a second state having a length less than the length of the cavity and a width greater than the width of the cavity.

4. The ammunition magazine according to claim 3, wherein:

the cavity includes a top wall, a bottom wall, an open side formed in the outer surface of the housing and adjacent to the well wall, and a closed side opposite the open side; and the insert includes an outer surface that is substantially flush with the outer surface of the housing and is spaced from the well wall when the insert is in the first state and projects through the open side and tightly engages the well wall when the insert is in the second state;

a bottom end that is substantially flush with the bottom wall of the cavity when the insert is in the first state and is spaced from the bottom wall of the cavity when the insert is in the second state.

5. The ammunition magazine according to claim 1, wherein the actuator comprises a screw extending through the bore in the upper portion of the housing, the screw including a threaded distal end extending into an internally threaded bore in the insert.

6. The ammunition magazine according to claim 4, wherein:

the expandable insert has an upper end and a lower end and includes a bore extending through the upper and lower ends, and an internally threaded plug carried in the lower end of the bore; and the actuator comprises a screw extending through the bore in the insert, the screw including a threaded distal end extending into the internally threaded plug.

7. The ammunition magazine according to claim 6, wherein the screw includes an enlarged head supported on the upper surface of the magazine.

8. The ammunition magazine according to claim 2, wherein:

the upper portion of the housing includes a top surface, an outer surface, a cavity opening outwardly toward the well wall, and a bore extending vertically downwardly through the top surface of the upper portion and intersecting with the cavity; and the locking assembly includes an expandable insert contained within the cavity in the upper portion of the housing, and an actuator extending downwardly through the bore in the upper portion of the housing and configured to exert a compressive force on the expandable insert.

9. The ammunition magazine according to claim 8, wherein:

the cavity has a fixed length and width; and the insert is formed of resilient material and is expandable under compression from a first state having a width approximately equal to the length and width of the cavity to an second state having a width greater than the width of the cavity.

10. The ammunition magazine according to claim 9, wherein:

the cavity includes a top wall, a bottom wall, an open side formed in the outer surface of the housing and adjacent to the well wall, and a closed side opposite the open side; and the insert includes an outer surface that is substantially flush with the outer surface of the housing and is spaced from the well wall when the insert is in the first state and projects through the open side and tightly engages the well wall when the insert is in the second state;

a bottom end that is substantially flush with the bottom wall of the cavity when the insert is in the first state and is spaced from the bottom wall of the cavity when the insert is in the second state.

11. The ammunition magazine according to claim 9, wherein the actuator comprises a screw extending through the bore in the upper portion of the housing, the screw including a threaded distal end extending into an internally threaded bore in the insert.

12. The ammunition magazine according to claim 10, wherein:

the expandable insert has an upper end and a lower end and includes a bore extending through the upper and lower ends, and an internally threaded plug carried in the lower end of the bore; and the actuator comprises a screw extending through the bore in the insert, the screw including a threaded distal end extending into the internally threaded plug.

13. The ammunition magazine according to claim 12, wherein the screw includes an enlarged head supported on the upper surface of the magazine.

* * * * *